US007423613B2

(12) United States Patent
Joo et al.

(10) Patent No.: US 7,423,613 B2
(45) Date of Patent: Sep. 9, 2008

(54) METHOD AND APPARATUS TO AUTOMATICALLY CONTROL POWER OF ADDRESS DATA FOR PLASMA DISPLAY PANEL, AND PLASMA DISPLAY PANEL INCLUDING THE APPARATUS

(75) Inventors: Mi-Young Joo, Suwon-si (KR); Im-Su Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 594 days.

(21) Appl. No.: 10/947,331

(22) Filed: Sep. 23, 2004

(65) Prior Publication Data

US 2005/0068265 A1 Mar. 31, 2005

(30) Foreign Application Priority Data

Sep. 26, 2003 (KR) ..... 10-2003-0066891

(51) Int. Cl.
*G09G 3/28* (2006.01)

(52) U.S. Cl. ..... 345/60

(58) Field of Classification Search ..... 345/60, 345/63, 68, 211, 690, 692
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix-A—Description of Technology, Annex B—Relationship Between Voltage Terms and Discharge Characteristics; Annex C—Gaps and Annex D—Manufacturing.

*Primary Examiner*—Richard Hjerpe
*Assistant Examiner*—Shaheda A Abdin
(74) *Attorney, Agent, or Firm*—Robert E. Bushnell, Esq.

(57) ABSTRACT

A method and apparatus to automatically control power of address data in a PDP includes a plurality of address electrodes, a plurality of scan electrodes, and a plurality of sustain electrodes arranged in pairs with the scan electrodes, and a PDP including the apparatus. The sum of pixel value differences between adjacent ones of successive lines in input image data is calculated, and an address power control (APC) level corresponding to the calculated line pixel value difference sum is determined. The image data is then repeatedly multiplied by a gain initially corresponding to the start gain and sequentially decremented by a predetermined value from the start gain upon every multiplication until the gain corresponds to the end gain, to output corrected address data.

19 Claims, 11 Drawing Sheets

U.S. PATENT DOCUMENTS

| | | | | |
|---|---|---|---|---|
| 6,177,914 | B1 * | 1/2001 | Iwama et al. | 345/60 |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,091,934 | B2 * | 8/2006 | Kim et al. | 345/60 |
| 2001/0026253 | A1 * | 10/2001 | Eo | 345/60 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| KR | 10-2004-0011711 | 2/2004 |

* cited by examiner

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |

| Stage | Start Gain Point (15:11) End Gain Point (7:0) | End Gain Point (10:6) [(value × 4) + 4] | Time(5:0) [value × 4] |
|---|---|---|---|
| 0 | 31 | 31 | 63 |
| 1 | 31 | 31 | 63 |
| 2 | 31 | 30 | 63 |
| ⋮ | ⋮ | ⋮ | ⋮ |
| 30 | 21 | 10 | 16 |
| 31 | 20 | 10 | 16 |

METHOD AND APPARATUS TO AUTOMATICALLY CONTROL POWER OF ADDRESS DATA FOR PLASMA DISPLAY PANEL, AND PLASMA DISPLAY PANEL INCLUDING THE APPARATUS

CLAIM OF PRIORITY

This application makes reference to, incorporates the same here, and claims all benefits accruing under 35 U.S.C. §119 from an application for METHOD AND APPARATUS TO AUTOMATICALLY CONTROL POWER OF ADDRESS DATA FOR PLASMA DISPLAY PANEL, AND PLASMA DISPLAY PANEL INCLUDING THE APPARATUS earlier filed in the Korean Intellectual Property Office on 26 Sep. 2003 and there duly assigned serial No. 2003-66891.

BACKGROUND OF THE INVENTION

1. Field of the Invention

The present invention relates to a plasma display panel (PDP), and more particularly to a method and apparatus to automatically control power of address data in a plasma display panel (PDP), and a PDP including the apparatus.

2. Description of the Related Art

Generally, PDPs require an apparatus to control power consumption in accordance with the load ratio of a frame to be displayed, because they consume a large amount of electric power due to driving characteristics thereof. Conventionally, such a power control is automatically carried out to reduce power consumption. In conventional cases, however, such an auto power control is carried out only for generation of sustain and scan pulses. That is, no auto power control is carried out for generation of address data. For this reason, conventional PDPs have a drawback of large power consumption in their PDP parts to drive address data.

Image data of a white-screen is shown in the following. It can be seen that all pixels in the image data of the white-screen have a value of 1. In this case, accordingly, there is little or no data variation of address electrodes. Also, the number of pulse switching operations is small. Thus, reactive power generated during a charging or discharging operation is reduced because power consumption increases in proportion to the number of switching operations. According to the driving waveform for the image data of the white-screen, only one switching operation is required for each column of the image data of the white-screen.

On the other hand, image data may have a dot pattern. It can be seen that the dot pattern image data has pixel values continuously varying between 1 and 0, so that it requires a number of switching operations. According to the driving waveform in this case, in the case of the dot pattern image data, there is a considerable data variation of address electrodes. Also, the pulse switching of the driving waveform is frequently made, thereby causing an increase in power consumption.

The switching operation is more frequently generated when the number of pixels having different values between the current and previous lines of address data is larger. In this case, there is a problem of an increase in power consumption.

SUMMARY OF THE INVENTION

It is an aspect of the present invention to solve the problems incurred in the related art, and to provide a method and apparatus to automatically control power of address data in a PDP, which are capable of reducing the number of switching operations for address data, and thus, reducing power consumption, while efficiently controlling brightness, and generation of heat and noise, and a PDP including the apparatus.

It is another object to provide an automatic control of the power of address data in PDP that is easy to implement and manufacture while being cost effective.

In accordance with one aspect, a method to automatically control power of address data in a plasma display panel including a plurality of address electrodes, a plurality of scan electrodes, and a plurality of sustain electrodes arranged in pairs with the scan electrodes is provided. In this method, a sum of pixel value differences between adjacent ones of successive lines in input image data is calculated, and an address power control (APC) level corresponding to the calculated line pixel value difference sum is determined. A start gain, an end gain, and a sustain time corresponding to the address APC value are output. The input image data is repeatedly multiplied by a gain initially corresponding to the start gain and sequentially decremented by a predetermined value from the start gain upon every multiplication until the gain corresponds to the end gain, to correct the input image data, and corrected image data signals are output.

In accordance with another aspect, the present invention provides an apparatus to automatically control power of address data in a plasma display panel including a plurality of address electrodes, a plurality of scan electrodes, and a plurality of sustain electrodes arranged in pairs with the scan electrodes, including a memory, an average signal level sensor, a power controller, an address power controller, and an address data generator. The memory stores sustain discharge information corresponding to a load ratio. The average signal level sensor measures a load ratio of an externally-inputted image signal. The power controller outputs sustain discharge information corresponding to a load ratio of currently-inputted data. The address power controller calculates a sum of pixel value differences between adjacent ones of successive lines in the image signal, determines a start gain, an end gain, and a sustain time, based on the calculated line pixel value difference sum, and repeatedly outputs a gain initially corresponding to the start gain and sequentially decremented by a predetermined value from the start gain until the gain corresponds to the end gain. The address data generator multiplies the image signal by respective gains outputted from the address power controller, and thus, generates address data.

In accordance with another aspect, the present invention provides a plasma display panel comprising a plasma panel, a controller, an address electrode driver, and a sustain/scan electrode driver. The plasma panel includes a plurality of address electrodes, a plurality of sustain electrodes, and a plurality of scan electrodes arranged in pairs with the scan electrodes.

The controller calculates a sum of pixel value differences between adjacent ones of successive lines in input image data, determines a start gain, an end gain, and a sustain time, based on the calculated line pixel value difference sum, generates address data by repeatedly multiplying the input image data by a gain initially corresponding to the start gain and sequentially decremented by a predetermined value from the start gain upon every multiplication until the gain corresponds to the end gain, measures a load ratio of the image signal, and outputs sustain discharge pulse information corresponding to the measured load ratio. The address electrode driver applies, to the address electrodes of the plasma panel, a voltage corresponding to the address data outputted from the controller. The sustain/scan electrode driver generates sustain pulses and scan pulses, based on the sustain discharge information outputted from the controller, and applies the generated sustain pulses and scan pulses to the sustain electrodes and scan electrodes, respectively.

The present invention can be realized as computer-executable instructions stored in computer-readable media.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figures 1, 2:
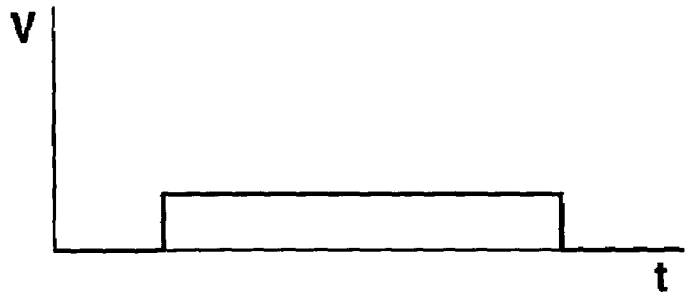
FIG. 1 is a diagram showing image data of a white-screen.
FIG. 2 is a switching waveform diagram for the image data of FIG. 1.

Turning now to the drawings, FIG. 1 is a diagram showing image data of a white-screen.

Referring to FIG. 1, it can be seen that all pixels in the image data of the white-screen have a value of 1. In this case, accordingly, there is little or no data variation of address electrodes. Also, the number of pulse switching operations is small. Thus, reactive power generated during a charging or discharging operation is reduced because power consumption increases in proportion to the number of switching operations. The driving waveform for the image data of the white-screen is shown in FIG. 2. As shown in FIG. 2, only one switching operation is required for each column of the image data of the white-screen, as indicated by a solid line in FIG. 2.

On the other hand, image data may have a dot pattern.

Figures 3, 4:
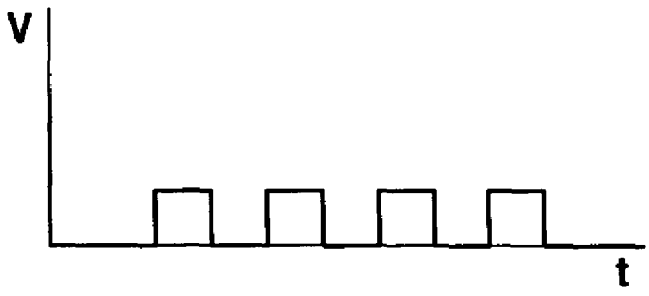
FIG. 3 is a diagram showing dot pattern image data.
FIG. 4 is a switching waveform diagram for the image data of FIG. 3.

FIG. 3 is a diagram showing dot pattern image data.

Referring to FIG. 3, it can be seen that the dot pattern image data has pixel values continuously varying between 1 and 0, so that it requires a number of switching operations. The driving waveform in this case is shown in FIG. 4.

As shown in FIG. 4, in the case of the dot pattern image data, there is a considerable data variation of address electrodes. Also, the pulse switching of the driving waveform is frequently made, thereby causing an increase in power consumption.

The switching operation is more frequently generated when the number of pixels having different values between the current and previous lines of address data is larger. In this case, there is a problem of an increase in power consumption.

In the following detailed description, only certain exemplary embodiments of the present invention are shown and described, by way of illustration. As those skilled in the art would recognize, the described exemplary embodiments may be modified in various ways, all without departing from the spirit or scope of the present invention.

Figure 5:
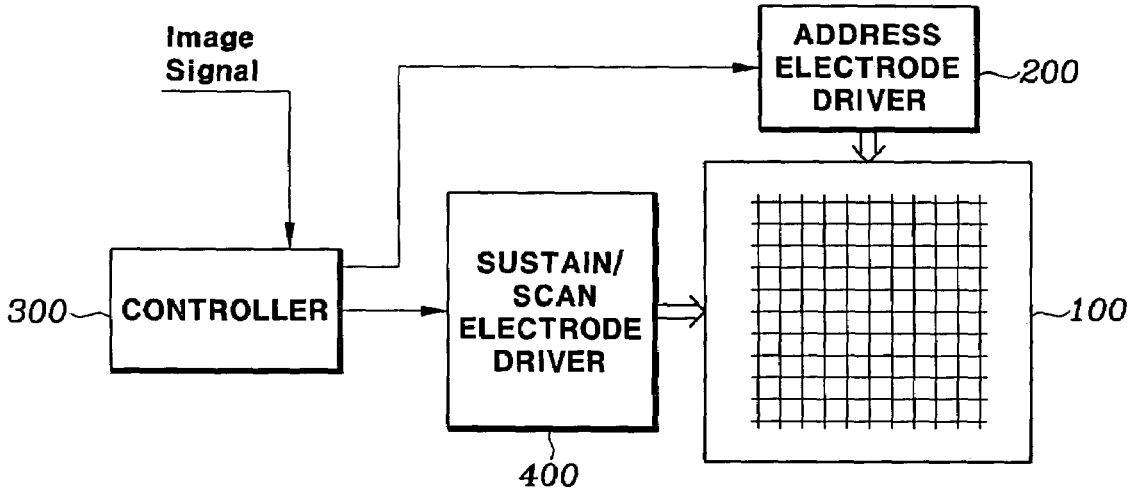
FIG. 5 is a block diagram illustrating a PDP according to an exemplary embodiment of the present invention.

FIG. 5 is a block diagram illustrating a PDP according to an exemplary embodiment of the present invention.

As shown in FIG. 5, the PDP includes a plasma panel 100, a controller 300, an address electrode driver 200, a sustain/scan electrode driver 400.

The plasma panel 100 includes a plurality of address electrodes, a plurality of sustain electrodes, and a plurality of scan electrodes. The sustain electrodes are arranged in pairs with the scan electrodes. The controller 300 calculates the sum of pixel value differences between adjacent ones of successive lines in input image data, and determines a start gain, an end gain, and a sustain time, based on the calculated line pixel value difference sum. The controller 300 then generates address data by repeatedly multiplying the input image data by a gain initially corresponding to the start gain and sequentially decremented by a predetermined value from the start gain upon every multiplication until the gain corresponds to the end gain. The controller 300 also measures the load ratio of the image signal, and outputs sustain discharge pulse information corresponding to the measured load ratio. The address electrode driver 200 applies, to the address electrodes of the PDP, a voltage corresponding to the address data outputted from the controller 300. The sustain/scan electrode driver 400 generates sustain pulses and scan pulses, based on the sustain discharge information outputted from the controller 300, and applies the generated sustain pulses and scan pulses to the sustain electrodes and scan electrodes, respectively.

Figure 6:
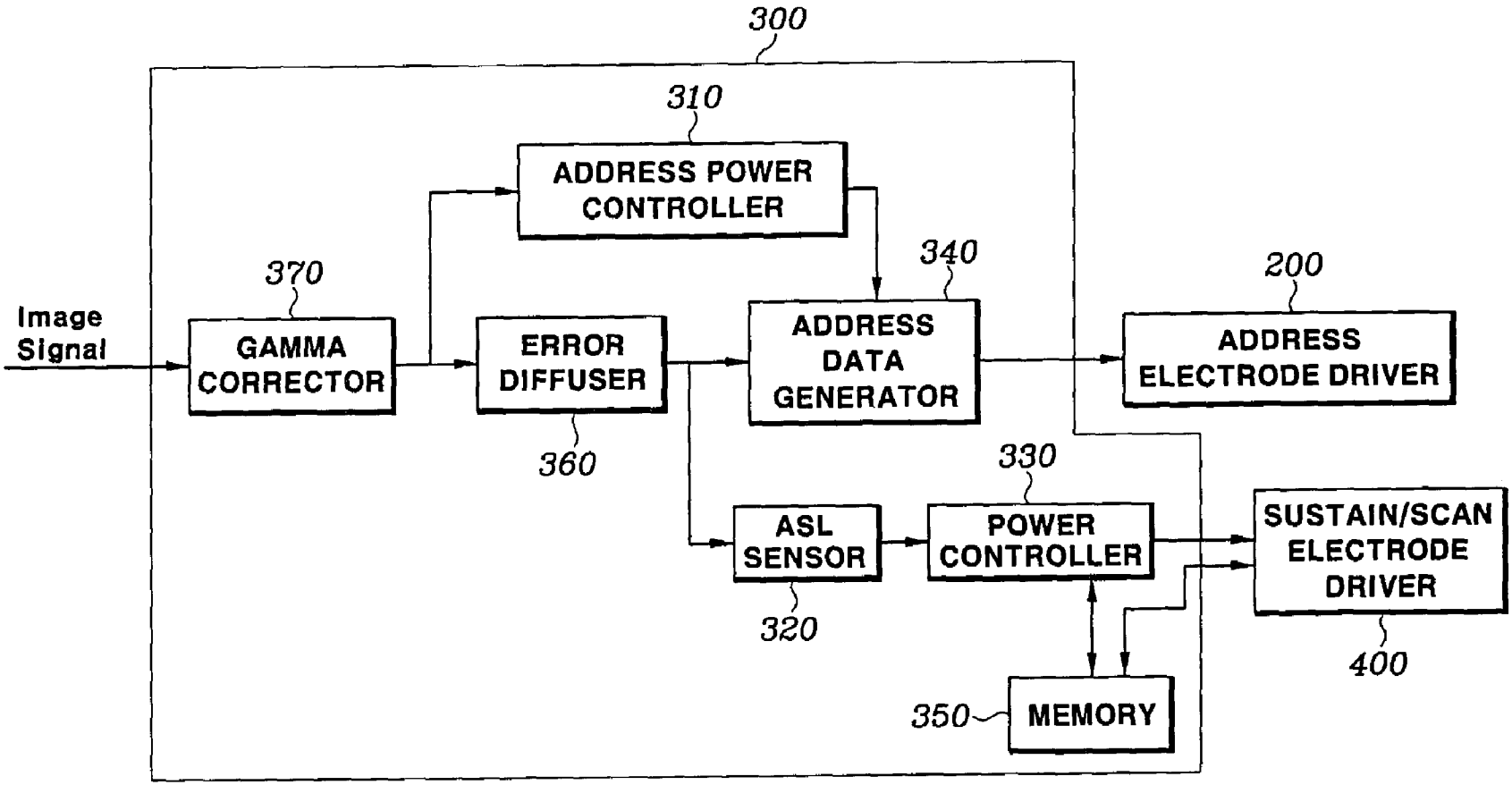
FIG. 6 is a block diagram illustrating a detailed configuration of a controller shown in FIG. 5.

FIG. 6 illustrates an internal configuration of the controller 300 shown in FIG. 5. As shown in FIG. 6, the controller 300 includes an address power controller 310, an address data generator 340, a sustain/scan power controller 330, an average signal level (ASL) sensor 320, a memory 350, an error diffuser 360, and a gamma corrector 370.

The gamma corrector 370 performs a gamma correction for the input image signal. The error diffuser 360 performs error diffusion for the gam ma-corrected image signal. The memory 350 stores sustain discharge information corresponding to the load ratio of the image signal. The average signal level sensor 320 measures the load ratio of the error-diffused image signal. The sustain/scan power controller 330 outputs sustain discharge information corresponding to the load ratio of the currently-input data. The address power controller 310 calculates the sum of pixel value differences between adjacent ones of successive lines in the gamma-corrected image signal, and determines a start gain, an end gain, and a sustain time, based on the calculated line pixel value difference sum. The address power controller 310 then repeatedly outputs a gain initially corresponding to the start gain and sequentially decremented by a predetermined value from the start gain until the gain corresponds to the end gain. The address data generator 340 multiplies the image signal by respective gains outputted from the address power controller 310, converts the resultant signals into gray scale data signals, sorts the gray scale data signals in accordance with the gray scales thereof, arranges the sorted gray scale data signals to meet a predetermined driving sequence, and outputs the arranged data signals.

Figure 7:
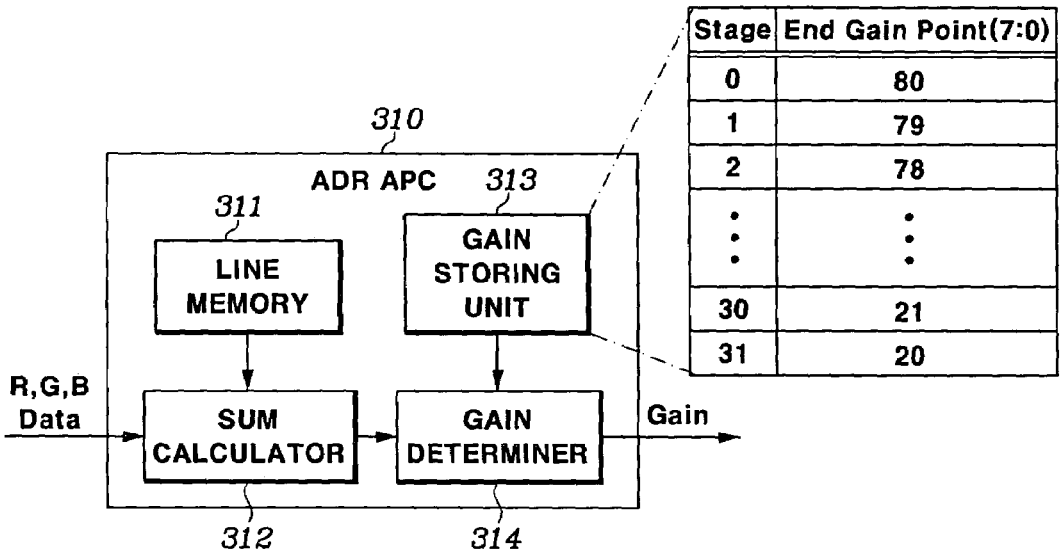
FIG. 7 is a block diagram illustrating a configuration of an address power controller shown in FIG. 6 in accordance with a first embodiment of the present invention.

FIG. 7 is a block diagram illustrating a configuration of the address power controller according to a first embodiment of the present invention.

As shown in FIG. 7, the address power controller includes a line memory 311, a sum calculator 312, a gain storing unit 313, and a gain determiner 314.

Hereinafter, a method and apparatus to automatically control power of address data in accordance with the present invention will be described in detail, along with operation of the PDP, which has the above-described configuration according to the illustrated embodiment of the present invention including the apparatus.

First, an image signal, which contains data components R, G, and B, and sync signals Hsync (horizontal synchronization) and Vsync (vertical synchronization), is externally inputted.

The gamma corrector 370 of the control unit 300 performs a gamma correction for the input image signal, and outputs the gamma-corrected image signal.

The error diffuser 360 performs error diffusion for the gamma-corrected image signal.

The average signal level sensor 320 measures the average signal level of the data components R, G, and B from the error-diffused image signal. The measured average signal level is applied to the sustain/scan power controller 330 as a load ratio.

The sustain/scan power controller 330 reads, from the memory 350, sustain discharge information corresponding to the load ratio outputted from the average signal level sensor 320, and outputs the read sustain discharge information to the sustain/scan electrode driver 400.

Based off the sustain discharge information, the sustain/scan electrode driver 400 reads, the number of sustain discharge pulses corresponding to the load ratio. Based on the read number of sustain discharge pulses, the sustain/scan electrode driver 400 applies sustain and scan pulses to the sustain and scan electrodes, respectively.

Meanwhile, the sum calculator 312 of the address power controller 310 stores the image signal in the line memory 311 in units of lines, calculates pixel value differences between adjacent ones of the stored successive lines of the image signal, and sums the calculated pixel value differences. Thus, the sum of line pixel value differences in one frame is derived.

The calculation of the line pixel value differences can be carried out, using the following Equation 1:

$$S = \sum_{I=1}^{N} \sum_{J=1}^{M} P_{i+1,j} - P_{i,j} \qquad \text{[Equation 1]}$$

where, "P" represents a pixel value, "i" represents a line, and "j" represents a column. Using Equation 1, it is possible to derive the sum of pixel value differences of adjacent ones of successive lines in image data having N lines and M columns.

Equation 1 may be modified for various purposes. For example, Equation 1 may be modified to perform the calculation in units of lines or to calculate the sum at once.

The sum calculator 312 calculates the pixel value difference between the previous line and the current line, the pixel value difference between the current line and the next line, the pixel value difference between the next line and the line after next, . . . , derives a sum S of the calculated pixel value differences, and outputs the derived sum to the gain determiner 314.

Figure 8:
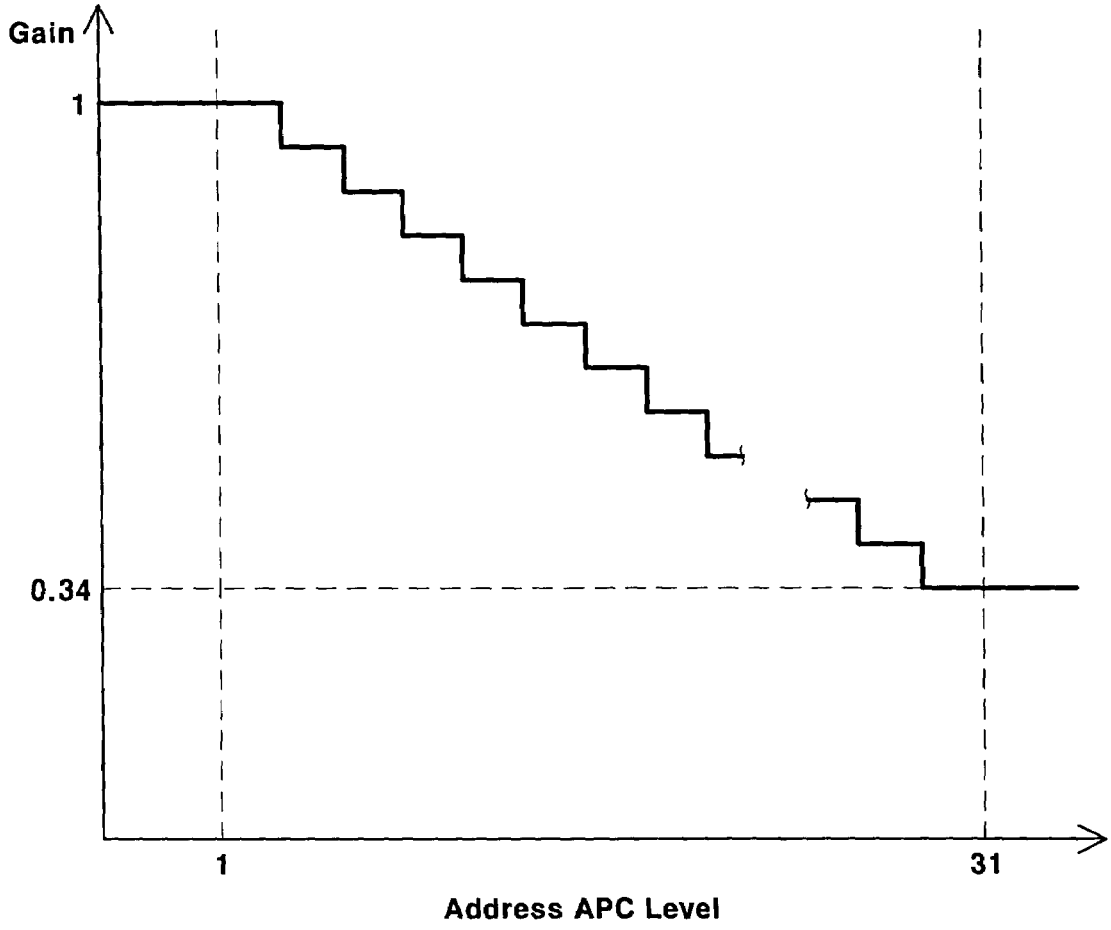
FIG. 8 is a graph depicting gain values respectively corresponding to APC levels.

The gain determiner 314 determines an auto power control (APC) level corresponding to the difference sum S, determines an end gain corresponding to the determined APC level while referring to a lookup table stored in the gain storing unit 313, and outputs the determined end gain. Gain values respectively corresponding to APC levels are depicted in FIG. 8.

The gain value is inversely proportional to the difference sum S, and ranges between 0 and 1. A large difference sum means a large data value difference between pixels. In this case, an increase in power consumption occurs. For this reason, it is necessary to reduce the data value difference between pixels through a multiplication of a gain value.

When the difference sum S is 0, the gain value corresponds to 1. As the difference sum increases, the gain value decreases. Such a gain value may be experimentally set, and stored in the form of a lookup table for subsequent use thereof. If necessary, the gain value may vary within a range causing no modification of the original image signal. Also, the gain value may be designed to be more than 1.

Figure 9:
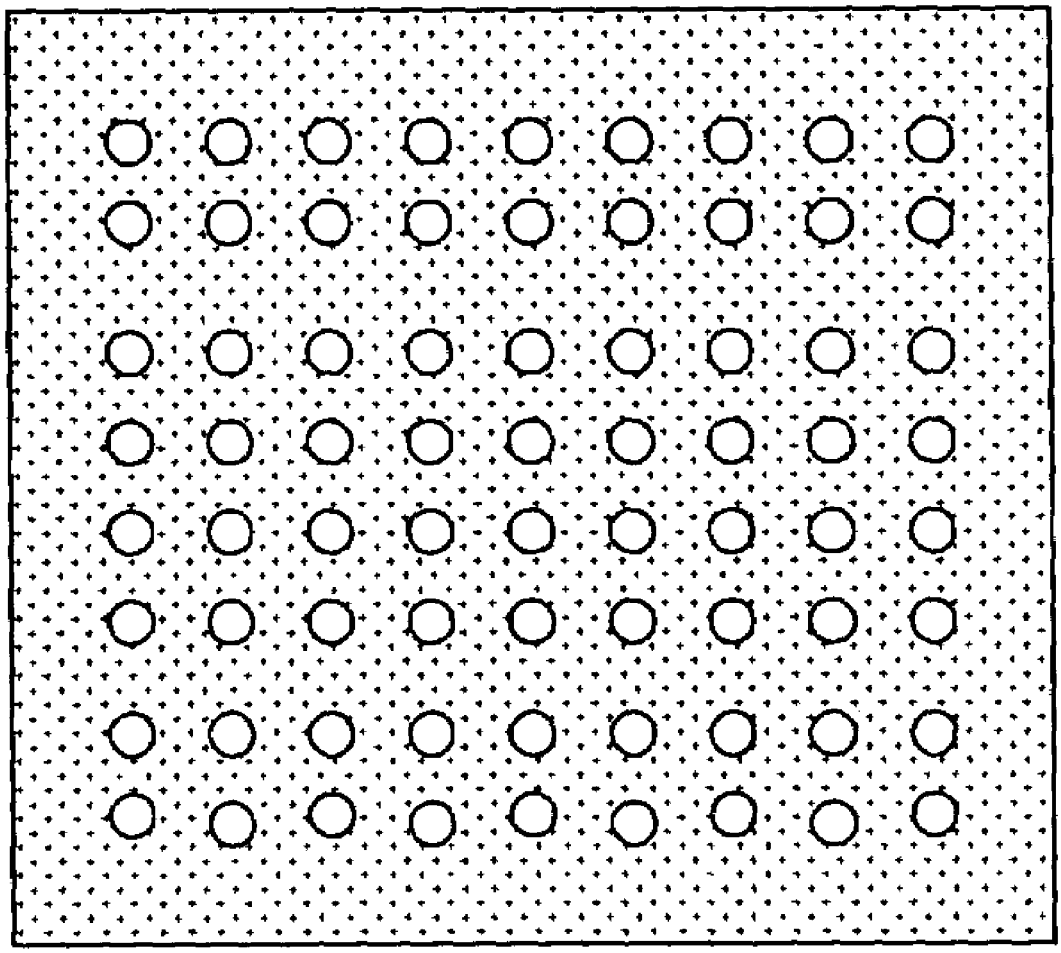
FIG. 9 is a schematic view illustrating an example of an image signal pattern causing high power consumption.

The address data generator 340 multiplies the image signal by each gain outputted from the gain determiner 314, thereby outputting corrected data. The address data generator 340 converts the corrected data into a gray scale data signal. All gray scale data signals are sorted in accordance with the gray scales thereof, and are arranged to meet a predetermined driving sequence. The address data generator 340 outputs the arranged data signals to the address electrode driver 200 as address data.

Where the input image signal has a pattern causing high power consumption, as shown in FIG. 9, calculation of an output gray scale may be carried out, as follows.

Where it is assumed that the input image signal of FIG. 9 has an input gray scale of 255 and an APC (auto power control) level of 30, an output gray scale is calculated, as follows:

$$\text{Output Gray Scale} = \text{Input Gray Scale} \times \text{Gain} = (255 \times 0.5) = 128$$

That is, an output gray scale of 128 is outputted for an input gray scale of 255.

When the address data driver 200 receives the address data from the address data generator 340, it applies, to the address electrode lines, a voltage corresponding to the received address data.

Thus, image data is displayed on the PDP (plasma display panel) 100.

As is apparent from the above description, when the data value difference between pixels in an input image signal is large, it is multiplied by a gain to reduce the number of switching operations to be conducted. Accordingly, it is possible to reduce power consumption.

Meanwhile, values stored in the lookup table in accordance with the first embodiment of the present invention are values experimentally determined, taking into consideration noise and power consumption. For this reason, although it is possible to reduce instantaneous power consumption, and generation of heat and noise, an abrupt decrease in brightness may occur.

In order to appropriately control instantaneous power consumption, generation of heat and noise, and brightness, a means is provided in accordance with a second embodiment of the present invention.

Figure 10:
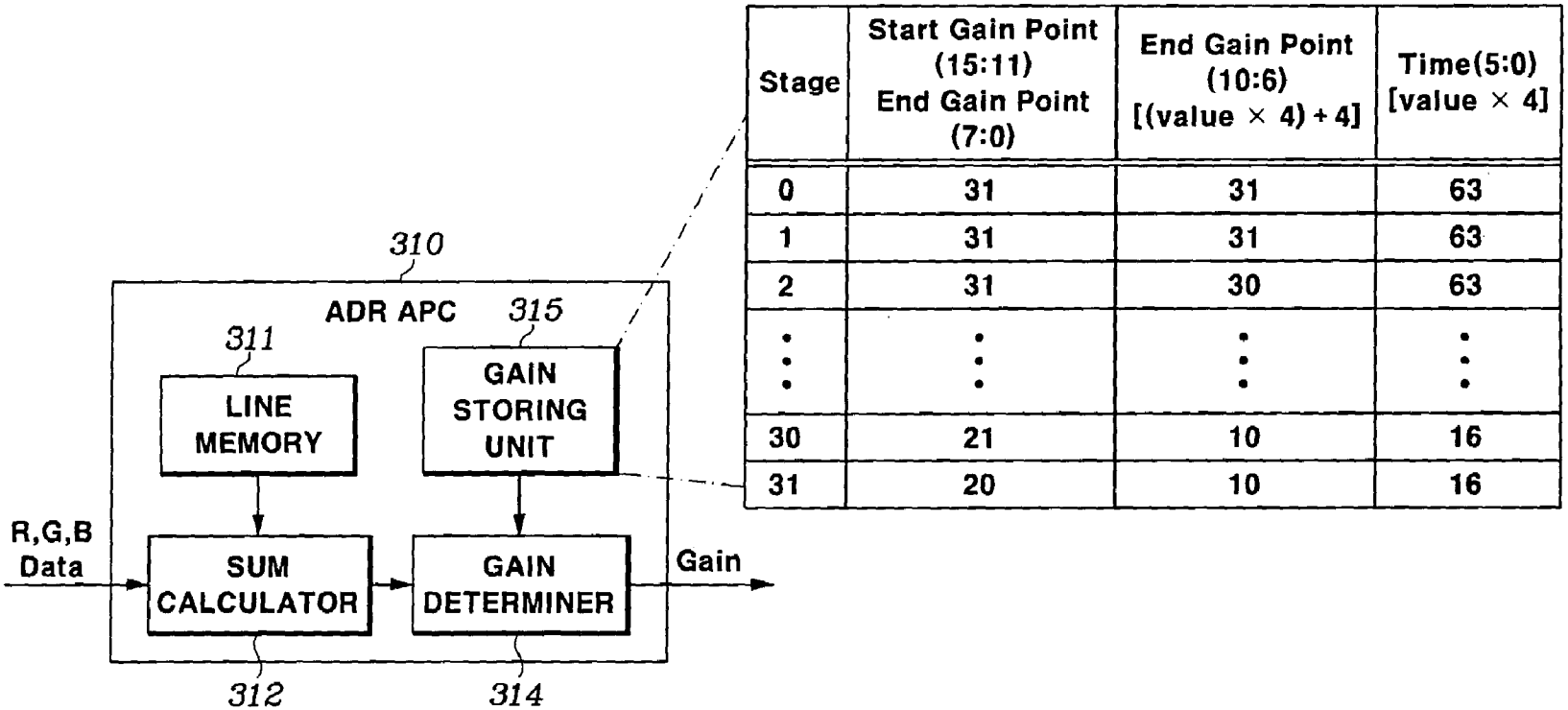
FIG. 10 is a block diagram illustrating a configuration of the address power controller shown in FIG. 6 in accordance with a second embodiment of the present invention.

FIG. 10 is a block diagram illustrating an address power controller according to the second embodiment of the present invention.

As shown in FIG. 10, the address power controller according to the second embodiment of the present invention includes a line memory 311 to store an input image signal in units of lines, and a sum calculator 312 to calculate pixel value differences between adjacent ones of the successive lines of the image signal stored in the line memory 311, to sum the calculated pixel value differences, and thus, to derive the sum of line pixel value differences of the image signal for one frame. The address power controller also includes a gain storing unit 315 to store information about respective start gains, respective end gains, and respective sustain times corresponding to various sums of line pixel value differences for one frame, and a gain determiner 314 to determine an address APC level corresponding to the difference sum derived by the sum calculator 312, to read a start gain, an end gain, and a sustain time corresponding to the determined APC level while referring to the information stored in the gain storing unit 315, and to repeatedly output a gain, which initially corresponds to the start gain, and is sequentially decremented by a predetermined value from the start gain after every gain outputting until the gain corresponds to the end gain, while sustaining the gain for the sustain time.

Now, operation of the address power controller having the above-described configuration according to the second embodiment of the present invention will be described.

The operation of the address power controller according to the second embodiment is similar to that of the first embodiment. In accordance with the second embodiment of the present invention, the information in the gain storing unit 315 is stored in the form of a lookup table in a state of being classified into start gains, end gains, and sustain times.

In accordance with the second embodiment of the present invention, after the gain determiner 314 determines the address APC level of an input image signal having R (red), G (green), and B (blue) components, it receives a start gain, an end gain, and a sustain time from the lookup table.

The gain determiner 314 repeatedly outputs gains, which initially corresponds to the start gain, and is sequentially decremented by the predetermined value from the start gain after every gain outputting until the gain corresponds to the end gain, while sustaining the gain for the sustain time. The address data generator 340 receives the gains sequentially outputted from the gain determiner 314, and multiplies the input image data by the gains, respectively, thereby outputting the resultant data as address data.

Figure 11:
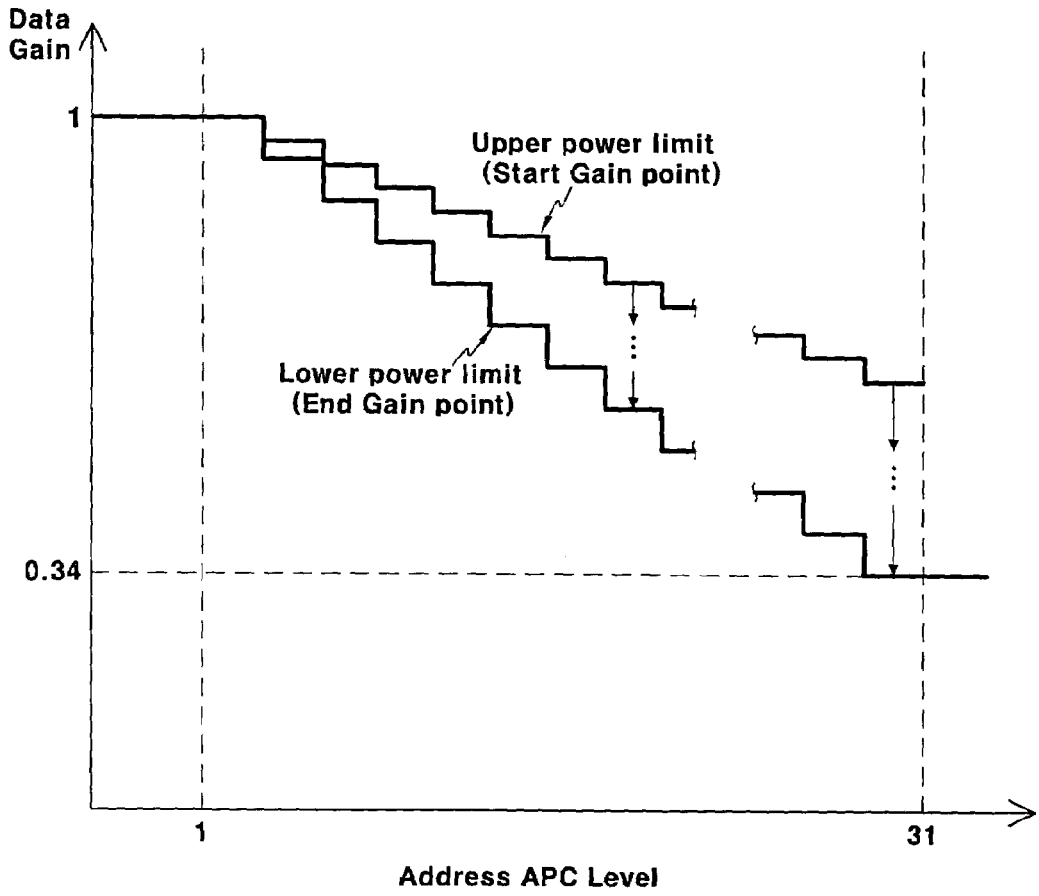
FIG. 11 is a graph depicting a start gain and an end gain varying depending on an address APC level.

Gains outputted in accordance with the above-described operation are depicted in FIG. 11.

Referring to FIG. 11, it can be seen that the start gain and end gain vary depending on the address APC level, and the difference between the start gain and the end gain increases at a higher APC level.

The output gain is decremented from the start gain by a predetermined value until the output gain reaches the end gain. Subsequently, the output gain is sustained at a value corresponding to the end gain.

Figure 12:
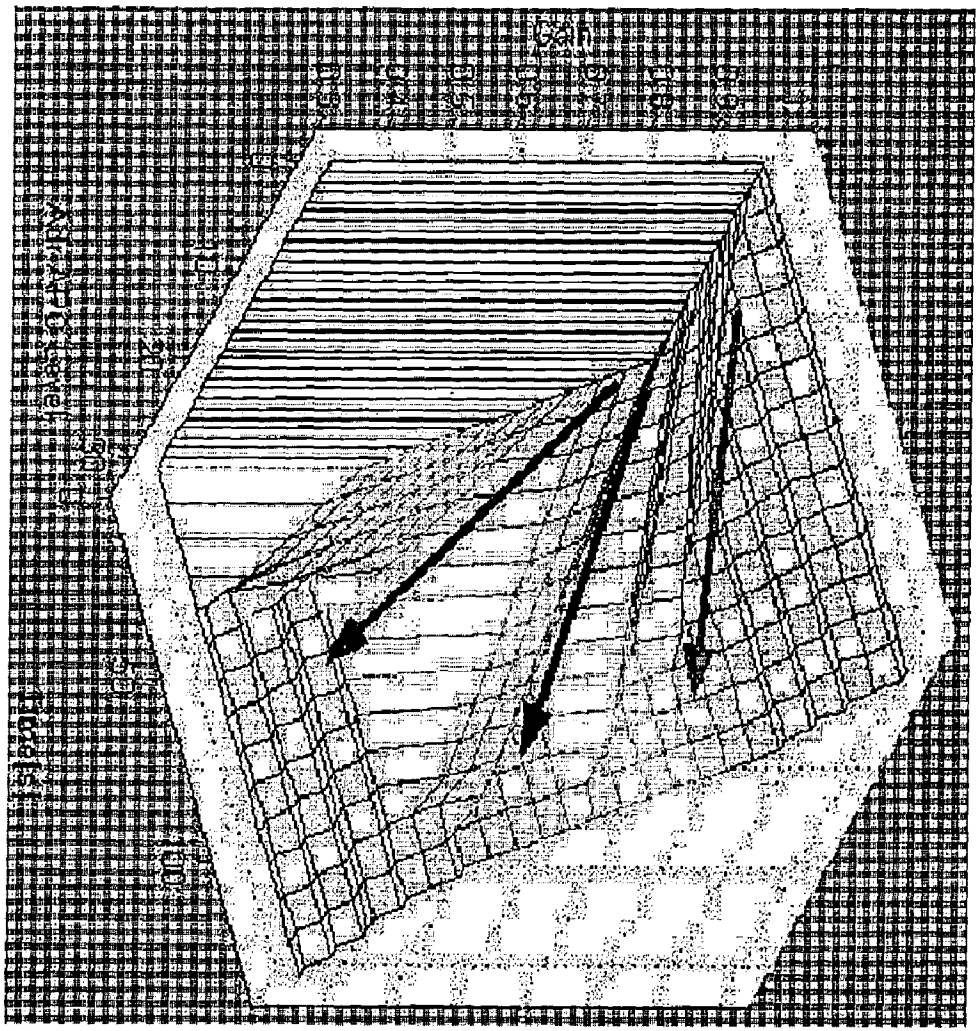
FIG. 12 is a three-dimensional graph corresponding to FIG. 12.

The graph of FIG. 11 is three-dimensionally shown in FIG. 12.

In accordance with the second embodiment of the present invention, the start gain multiplied by the RGB (red, green, blue) image signal varies depending on the address APC level of the image signal. Accordingly, it is possible to completely control instantaneous power consumption, generation of heat and noise, and brightness.

Referring to FIG. 12, it can be seen that the start gain and end gain vary depending on the address APC level, the time from the start gain to the end gain is shortened at a higher address APC level, and the falling slope of the gain is gentle at a low address APC level, while being sharper at a higher address APC level.

Figure 13:
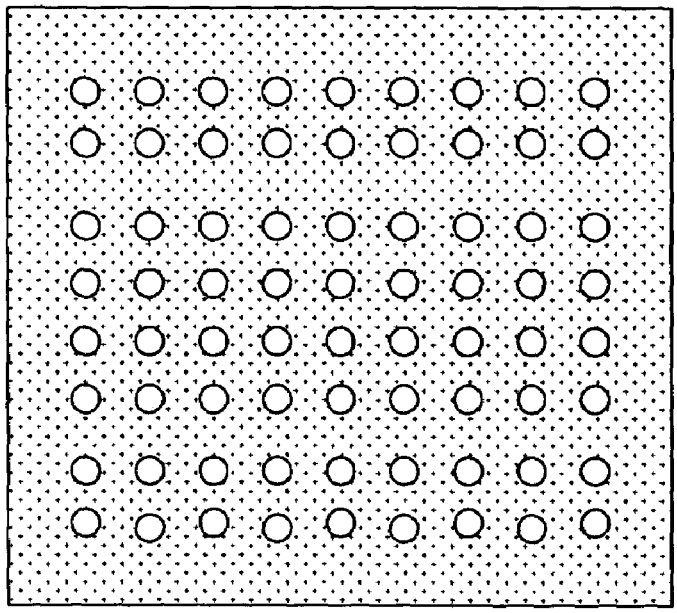
FIGS. 13 and 14 are schematic views respectively illustrating two image signal patterns having different address APC levels.

Practically, an output gray scale is varied from an input gray scale in accordance with the address APC level. This will be described with reference to FIGS. 13 and 14.

Where an image signal having a pattern shown in FIG. 13 is inputted, and the image signal has a gray scale of 255 and an address APC level of 30, the following gray scale is outputted:

Upon inputting of the pattern:

$$\begin{aligned}
\text{Output Gray Scale} &= [\text{Input Gray Scale} \times \text{Gain}] \\
&= [255 \times 0.6875] = 175 \\
\text{After 1 second: Output Gray Scale} &= [\text{Input Gray Scale} \times \text{Gain}] \\
&= [255 \times 0.6796] = 173 \\
\text{After 2 seconds: Output Gray Scale} &= [\text{Input Gray Scale} \times \text{Gain}] \\
&= [255 \times 0.679] = 171 \\
\text{After 48 seconds: Output Gray Scale} &= [\text{Input Gray Scale} \times \text{Gain}] \\
&= [255 \times 0.3438] = 88
\end{aligned}$$

Figure 14:
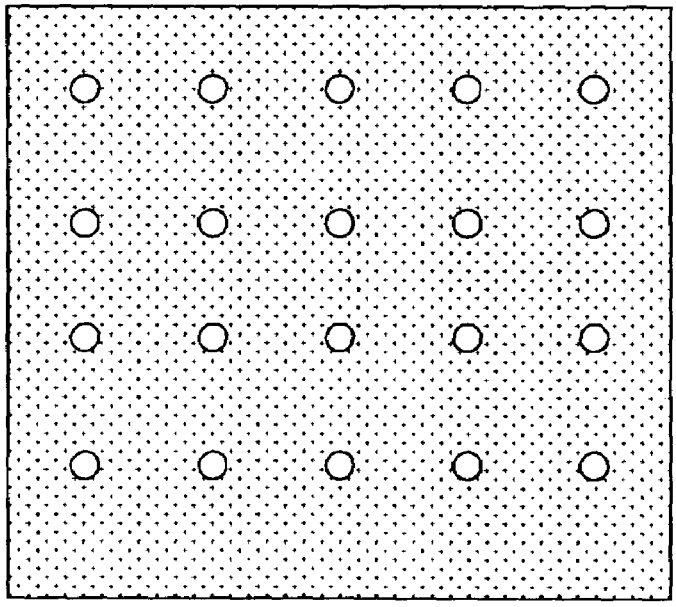

Thus, when the input gray scale is 255, different output gray scales are outputted, which have values varying in the order of 175→173→171→ . . . →88 with the lapse of time, respectively.

Where an image signal having a pattern shown in FIG. 14 is inputted, and the image signal has a gray scale of 255 and an address APC level of 20, the following gray scale is outputted:

Upon inputting of the pattern:

$$\begin{aligned}
\text{Output Gray Scale} &= [\text{Input Gray Scale} \times \text{Gain}] \\
&= [255 \times 1.0000] = 255 \\
\text{After 1 second: Output Gray Scale} &= [\text{Input Gray Scale} \times \text{Gain}] \\
&= [255 \times 0.9922] = 253 \\
\text{After 3 seconds: Output Gray Scale} &= [\text{Input Gray Scale} \times \text{Gain}] \\
&= [255 \times 0.9844] = 251 \\
\text{After 140 seconds: Output Gray Scale} &= [\text{Input Gray Scale} \times \text{Gain}] \\
&= [255 \times 0.5000] = 128
\end{aligned}$$

Thus, when the input gray scale is 255, different output gray scales are outputted, which have values varying in the order of 255→253→251→ . . . →128 with the lapse of time, respectively.

After comparing the cases of FIGS. 13 and 14, it can be seen that the cases of FIGS. 13 and 14 have different setting values in terms of the gray scale corresponding to the start gain, the gray scale corresponding to the end gain, the sustain time of the output gray scale, and the time from the start gain to the end gain.

Thus, in accordance with the second embodiment of the present invention, problems associated with brightness, generation of heat, power consumption, and noise are completely solved by appropriately determining the gain and sustain time, depending on the address APC level.

As is apparent from the above description, the present invention provides a method and apparatus to automatically control power of address data in a PDP, in which an address power control is carried out, based on a start gain, an end gain, and a sustain time corresponding to an address APC level of an input image signal, thereby reducing power consumption, generation of heat and noise, while achieving an improvement in brightness, and a PDP including the apparatus.

The present invention can be realized as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media and infrared media. The data stored on the computer-readable media may be transmitted via a communication medium such as a carrier wave (e.g., by transmission via the Internet or to another computer). The information stored on computer-readable media generally embodies computer-readable instructions, data structures, program modules or other data; this information may be superimposed on a modulated signal such as the carrier wave or other transportable mechanism including any information delivery media medium. Communication media may include wireless media such as radio frequency, infrared microwaves, and wired media such as a wired network. Also, the computer-readable media can store computer-readable codes that are distributed in computers connected via a network. The computer readable media also includes cooperating or interconnected computer readable media that are in the processing system or are distributed among multiple processing systems that may be local or remote to the processing system. The present invention contemplated the use of computer-readable media having stored thereon a data structure including a plurality of fields containing data representing the techniques of the present invention.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus to automatically control power of address data in a plasma display panel including a plurality of address electrodes, a plurality of scan electrodes, and a plurality of sustain electrodes arranged in pairs with the scan electrodes, comprising:

a memory to store sustain discharge information corresponding to a load ratio;

an average signal level sensor to measure a load ratio of an externally-inputted image signal;

a power controller to output sustain discharge information corresponding to a load ratio of currently-inputted data;

an address power controller to calculate a sum of pixel value differences between adjacent ones of successive lines in the image signal, to determine a start gain, an end gain, and a sustain time, based on the calculated line pixel value difference sum, and to repeatedly output a gain initially corresponding to the start gain and sequentially decremented by a predetermined value from the start gain until the gain corresponds to the end gain; and an address data generator to multiply the image signal by respective gains outputted from said address power controller, and to generate address data.

2. The apparatus of claim 1, wherein the address power controller comprises:

a line memory to store an input image signal in units of lines;

a sum calculator to calculate pixel value differences between adjacent ones of the successive lines of the image signal stored in the line memory, to sum the calculated pixel value differences, and to derive the sum of line pixel value differences of the image signal for one frame;

a gain storing unit to store information about respective start gains, respective end gains, and respective sustain times corresponding to various sums of line pixel value differences for one frame;

and a gain determiner to determine an address auto power control level corresponding to the difference sum derived by said sum calculator, to read a start gain, an end gain, and a sustain time corresponding to the determined address auto power control level while referring to the information stored in said gain storing unit, and to repeatedly output a gain, which initially corresponds to the start gain, and is sequentially decremented by a predetermined value from the start gain after every gain outputting until the gain corresponds to the end gain, while sustaining the gain for the sustain time.

3. The apparatus of claim 2, wherein the start gain and the end gain vary depending on the address auto power control level, a time from the start gain to the end gain is shortened at a higher address auto power control level, and a falling slope of the output gain is gentle at a low address auto power control level, while being sharper at a higher address auto power control level.

4. The apparatus of claim 3, wherein:

the end gain is 1 when the sum of line pixel value differences of the image signal for one frame is 0;

the end gain is reduced as the difference sum increases; and the end gain ranges between 0 and 1.

5. The apparatus of claim 4, wherein the sustain time is shortened as the address auto power control level corresponding to the sum of line pixel value differences of the image signal for one frame increases.

6. The apparatus of claim 5, wherein, when the image data has N lines and M columns, the sum of line pixel value differences of the image signal for one frame is calculated by the following equation for sum S:

$$S = \sum_{I=1}^{N} \sum_{J=1}^{M} P_{i+1,j} - P_{i,j}$$

where, "P" represents a pixel value, "i" represents a line, and "j" represents a column.

7. The apparatus of claim 5, wherein the address data generator multiplies the image signal by respective gains output from said address power controller to correct data of the image signal, converts the corrected image data signals into gray scale data signals, sorts the gray scale data signals in accordance with gray scales thereof, arranges the sorted gray scale data signals to meet a predetermined driving sequence, and outputs the arranged data signals.

8. A plasma display panel comprising:

a plasma panel including a plurality of address electrodes, a plurality of sustain electrodes, and a plurality of scan electrodes;

a controller to calculate a sum of pixel value differences between adjacent ones of successive lines in input image data, to determine a start gain, an end gain, and a sustain time, based on the calculated line pixel value difference sum, to generate address data by repeatedly multiplying the input image data by a gain initially corresponding to the start gain and sequentially decremented by a predetermined value from the start gain upon every multiplication until the gain corresponds to the end gain, to measure a load ratio of the image signal, and to output sustain discharge pulse information corresponding to the measured load ratio;

an address electrode driver to apply, to said address electrodes of said plasma panel, a voltage corresponding to the address data outputted from the controller; and a sustain and scan electrode driver to generate sustain pulses and scan pulses, based on the sustain discharge information outputted from said controller, and apply the generated sustain pulses and scan pulses to said sustain electrodes and scan electrodes, respectively.

9. The plasma display panel of claim 8, wherein said controller comprises:

a memory to store sustain discharge information corresponding to a load ratio;

an average signal level sensor to measure a load ratio of an externally-inputted image signal;

a power controller to output sustain discharge information corresponding to a load ratio of currently-inputted data;

an address power controller to calculate a sum of pixel value differences between adjacent ones of successive lines in the image signal, to determine a start gain, an end gain, and a sustain time, based on the calculated line pixel value difference sum, and to repeatedly output a gain initially corresponding to the start gain and sequentially decremented by a predetermined value from the start gain until the gain corresponds to the end gain; and an address data generator to multiply the image signal by respective gains outputted from the address power controller, and to generate address data.

10. The plasma display panel of claim 9, wherein said address power controller comprises:

a line memory to store an input image signal in units of lines;

a sum calculator to calculate pixel value differences between adjacent ones of the successive lines of the image signal stored in the line memory, to sum the calculated pixel value differences, and to derive the sum of line pixel value differences of the image signal for one frame;

a gain storing unit to store information about respective start gains, respective end gains, and respective sustain times corresponding to various sums of line pixel value differences for one frame; and a gain determiner to determine an address auto power control level corresponding to the difference sum derived by said sum calculator, to read a start gain, an end gain, and a sustain time corresponding to the determined address auto power control level while referring to the information stored in said gain storing unit, and to repeatedly output a gain, which initially corresponds to the start gain, and is sequentially decremented by a predetermined value from the start gain after every gain outputting until the gain corresponds to the end gain, while sustaining the gain for the sustain time.

11. The plasma display panel of claim 10, wherein the start gain and the end gain vary depending on the address auto power control level, a time from the start gain to the end gain is shortened at a higher address auto power control level, and a falling slope of the output gain is gentle at a low address auto power control level, while being sharper at a higher address auto power control level.

12. The plasma display panel of claim 11, wherein the end gain is reduced as the address auto power control level corresponding to the sum of line pixel value differences of the image signal increases, and the sustain time is shortened as the address auto power control level increases.

13. A method to automatically control power of address data in a plasma display panel including a plurality of address electrodes, a plurality of scan electrodes, and a plurality of sustain electrodes arranged in pairs with the scan electrodes, comprising:

calculating a sum of pixel value differences between adjacent ones of successive lines in input image data, and determining an address power control level corresponding to the calculated line pixel value difference sum;

outputting a start gain, an end gain, and a sustain time corresponding to the address auto power control value; and repeatedly multiplying the input image data by a gain initially corresponding to the start gain and sequentially decremented by a predetermined value from the start gain upon every multiplication until the gain corresponds to the end gain, to correct the input image data, and outputting corrected image data signals.

14. The method of claim 13, further comprising:

converting the corrected image data signals into gray scale data signals, sorting the gray scale data signals in accordance with gray scales thereof, arranging the sorted gray scale data signals to meet a predetermined driving sequence, and outputting the arranged data signals.

15. The method of claim 14, further comprising:

measuring a load ratio of the input image data, and outputting sustain discharge pulse information corresponding to the measured load;

generating sustain pulses and scan pulses corresponding to the sustain discharge pulse information, and applying the sustain pulses and scan pulses to the sustain electrodes and scan electrodes, respectively; and generating address data corresponding to the rearranged data signals, and applying the address data to the address electrodes.

16. The method of claim 15, wherein the end gain is reduced as the address auto power control level corresponding to the sum of line pixel value differences of the image signal increases, and the sustain time is shortened as the address auto power control level increases.

17. A computer-readable medium storing computer executable instructions for performing a method, said method comprised of:

calculating a sum of pixel value differences between adjacent ones of successive lines in input image data, and determining an address power control level corresponding to the calculated line pixel value difference sum;

outputting a start gain, an end gain, and a sustain time corresponding to the address auto power control value;

multiplying the input image data for a plurality of iterations by a gain initially corresponding to the start gain and sequentially decreased by a certain value from the start gain upon every multiplication until the gain corresponds to the end gain, to correct the input image data, and outputting corrected image data signals;

converting the corrected image data signals into gray scale data signals, sorting the gray scale data signals in accordance with gray scales thereof, arranging the sorted gray scale data signals to meet a predetermined driving sequence, and outputting the arranged data signals;

measuring a load ratio of the input image data, and outputting sustain discharge pulse information corresponding to the measured load;

generating sustain pulses and scan pulses corresponding to the sustain discharge pulse information, and applying the sustain pulses and scan pulses to the sustain electrodes and scan electrodes, respectively; and generating address data corresponding to the rearranged data signals, and applying the address data to the address electrodes.

18. A computer-readable medium having stored on said medium a data structure readable by a computer, said data structure comprising:

a first field containing data representing storing sustain discharge information corresponding to a load ratio;

a second field containing data representing measuring measurement of a load ratio of an externally-inputted image signal by an average signal level sensor;

a third field containing data representing outputting sustain discharge information corresponding to a load ratio of currently-inputted data by a power controller;

a fourth field containing data representing determining, by an address power controller, a sum of pixel value differences between adjacent ones of successive lines in the image signal, to determine a start gain, an end gain, and a sustain time, based on the calculated line pixel value difference sum, and to repeatedly output a gain initially corresponding to the start gain and sequentially decrease by a certain value from the start gain until the gain corresponds to the end gain; and a fifth field containing data representing multiply, by an address data generator, the image signal by respective gains outputted from said address power controller, and to generate address data.

19. An apparatus to automatically control power of address data in a plasma display panel including a plurality of address electrodes, a plurality of scan electrodes, and a plurality of sustain electrodes arranged in pairs with the scan electrodes, comprising:

a memory to store sustain discharge information corresponding to a load ratio;

an average signal level sensor to measure a load ratio of an externally-inputted image signal;

a power controller to output sustain discharge information corresponding to a load ratio of currently-inputted data;

an address power controller to calculate a sum of pixel value differences between adjacent ones of successive lines in the image signal, to determine a start gain, an end gain, and a sustain time, based upon the calculated line pixel value difference sum, and to output a series of gains, with the first gain in the series of gains corresponding to the start gain, the gains following the first gain being sequentially decremented by a predetermined value until reaching the end gain; and an address data generator to multiply the image signal by respective gains in the series of gains outputted from said address power controller, and to generate address data.

* * * * *